United States Patent [19]

Fujita

[11] 4,354,464

[45] Oct. 19, 1982

[54] AIR INTAKE ARRANGEMENT FOR DIESEL ENGINE

[75] Inventor: Teruhiro Fujita, Hiroshima, Japan

[73] Assignee: Toyo Kogyo Co., Ltd., Hiroshima, Japan

[21] Appl. No.: 211,714

[22] Filed: Dec. 1, 1980

[30] Foreign Application Priority Data

Dec. 8, 1979 [JP] Japan ..... 54-159649
Jan. 16, 1980 [JP] Japan ..... 55-3931

[51] Int. Cl.[3] ..... F02D 9/02; F02D 9/04

[52] U.S. Cl. ..... 123/323; 123/327; 123/340; 123/585

[58] Field of Search ..... 123/320, 323, 327, 340, 123/378, 389, 531, 585, 588, 180 R; 188/273

[56] References Cited

U.S. PATENT DOCUMENTS 3,368,345 2/1968 Walker ..... 123/323 X
3,960,122 6/1976 Perrin ..... 123/323
4,058,101 11/1977 Taira et al. ..... 123/283
4,149,618 4/1979 Horie ..... 123/323 X
4,187,821 2/1980 Zebli ..... 123/588 X
4,237,838 12/1980 Kinugawa et al. ..... 123/327

FOREIGN PATENT DOCUMENTS 43-14326 6/1968 Japan .
54-152714 12/1979 Japan .

*Primary Examiner*—William A. Cuchlinski, Jr.
*Attorney, Agent, or Firm*—Wenderoth, Lind & Ponack

[57] ABSTRACT

An improved air intake arrangement for Diesel engine in which an intake air shutter valve is provided in an intake air passage of the engine for closing the intake air passage when the degree of depression of an accelerator pedal is small, especially in engine idling and speed retardation, i.e. during non-load period, so as to reduce engine vibrations and noises during light-load operation by throttling the intake air passage or reducing the substantial effective passage area, and also deterioration of combustion is prevented by reducing throttling effect of the intake air shutter valve or increasing the passage area during cold period of the engine, while braking effect of an exhaust brake is maintained also by reducing throttling effect of the shutter valve or increasing the passage area.

7 Claims, 10 Drawing Figures

AIR INTAKE ARRANGEMENT FOR DIESEL ENGINE

BACKGROUND OF THE INVENTION

The present invention generally relates to an internal combustion engine and more particularly, to an air intake arrangement of a Diesel engine for use, for example, in a motor vehicle or the like.

Commonly, a Diesel engine, different from a gasoline engine, is not provided with a throttle valve in its air intake passage, and therefore, the amount of intake air becomes excessively large during light-load operation, especially in the case of engine idling, resulting in an increase of compression resistance of the engine, with torque variation tending to be produced. Accordingly, there is presented a problem that the engine is caused to vibrate due to the torque variations mentioned above, giving rise to engine noises resulting from the vibrations.

In order to overcome the disadvantages as described above, there has conventionally been proposed, for example, in U.S. Pat. No. 4,058,101, a control apparatus for Diesel engine in which an intake air shutter valve equivalent to a throttle valve is provided in an intake air passage for selective closing and opening of the intake air passage so as to close the intake air shutter valve only during the light-load operation (i.e. to reduce the effective passage area of the intake air passage) so that the amount of engine vibrations and vibration noises are decreased through reduction of the amount of intake air.

In order to confirm the effectiveness of the arrangement in said U.S. Pat. No. 4,058,101, the present inventors first carried out a series of experiments to investigate the relation between the amount of throttling of the intake air shutter valve and the amount of engine vibrations after engine warm-up had been completed (i.e. during the period after the engine has warmed up). In the above experiments, the amount of the throttling of the intake air shutter valve was represented by the intake air negative pressure downstream of the intake air shutter valve during the idling operation, i.e. when the engine was running at 600 r.p.m. It is to be noted that the amount of throttling of the intake air shutter valve will be represented hereinbelow in the similar manner to the above. Meanwhile, since the transmission case is also subjected to vibrations in a similar manner as the engine is caused to vibrate, and thus, the amount of engine vibrations may be regarded as equal to the amount of vibrations of the transmission case, the relation between the amount of throttling of the intake air shutter valve and the amount of transmission case vibrations was also studied in the experiments with respect to the warmed-up engine under the state of idling operation, the results of which are shown in FIG. 2. It is needless to say that noises due to the vibrations show a trend similar to the amount of vibrations of the transmission case.

Subsequently, upon review of the results of the experiments as described above, it is seen that the amount of vibrations of the transmission case is gradually decreased as the amount of throttling of the intake air shutter valve is increased from the fully opened state thereof (throttling amount of 3 mmHg). Therefore, it is ensured that the engine vibrations and noises due to the vibrations may be reduced with an increase in the amount of throttling of the intake air shutter valve.

Furthermore, upon study into the amount of throttling of the intake air shutter valve, it is noticed that the amount of vibrations of the transmission case (i.e. the amount of engine vibrations) is reduced by about 3 dB, or vibration energy is reduced to approximately ½, when the amount of throttling is increased by 100 mmHg with respect to the fully opened state of the intake air shutter valve. Additionally, it has also been confirmed that the reduction of the vibration energy to such an extent, i.e. reduction of the amount of vibration of the transmission case to below approximately 98 dB, is necessary.

On the other hand, when the amount of throttling exceeds 400 mmHg, the amount of intake air is extremely reduced, with consequent deterioration of the state of combustion, resulting in such problems as the occurrence of semi-misfire, the discharging of white smoke and the creation of the odor of formaldehyde.

As a result of the foregoing studies, has been found that it is desirable that the amount of throttling of the intake air shutter valve be in the region between 100 mmHg and 400 mmHg during idling operation at the completion of engine warm-up, and more preferably, in the range between 150 mmHg and 350 mmHg.

However, when the engine is in a cold state, if the amount of throttling of the intake air shutter valve is set to be above 100 mmHg in a similar manner as at the completion of engine warm-up described above even during the idling operation, the state of combustion is deteriorated as in the throttling to more than 400 mmHg upon completion of engine warming-up mentioned earlier, resulting in such inconveniences as semi-misfire, generation of white smoke and odor of formaldehyde, etc.

Accordingly, when the engine is in the cold state, it becomes necessary to reduce the amount of throttling of the intake air shutter as compared with that in the warmed-up state of the engine so as to increase the amount of intake air in order to improve the state of combustion.

Incidentally, some of the motor vehicles equipped with Diesel engines employ exhaust brakes, which include an exhaust brake valve operably provided in an exhaust passage of the engine for braking the motor vehicle by causing compression loss to take place through an increase of exhaust gas pressure within the exhaust passage upon closing of the exhaust brake valve, i.e. through an increase of compression resistance of the engine by raising the engine back pressure.

However, where the exhaust brake as described above is employed, noises or intake air noises are developed by rapid expansion of gas compressed within the engine and flowing backward into the intake air passage. For overcoming the above disadvantage, there has also been conventionally proposed an exhaust brake device, described for example, in Japanese Utility Model Publication Jikkosho No. 43-14326, in which the intake air passage is arranged to be throttled by closing the intake air shutter valve for reducing the passage area of the intake air passage even during use of the exhaust brake.

In the above known arrangement, the intake air shutter valve may be closed even during speed retardation as well as in the idling operation, but, since it is necessary to supply more than a predetermined amount of intake air into the combustion chamber in order to achieve sufficient functioning of the exhaust brake, when the reduction of the intake air noises during actuation of the exhaust brake is intended by operating the intake air shutter valve even during the functioning of the exhaust brake, the amount of throttling of the intake air shutter device can not be increased to a large extent, because upon reduction of the intake air amount supplied into the combustion chamber by increasing the amount of throttling of the intake air shutter device (i.e. the degree of closing of the intake air shutter valve), the pressure in the combustion chamber becomes low, even if discharging of the exhaust gas is suppressed by the exhaust brake valve, with the compression ratio remaining large, and thus, it is not possible to subject the engine to a sufficiently large compression loss.

Therefore, for reducing the intake air noises, while maintaining braking performance of the exhaust brake in a favorable state during speed retardation, with the exhaust brake functioning, it is surmised that there is a preferable range of throttling of the intake air shutter valve.

According to the experiments, it is desirable that the amount of throttling of the intake air shutter valve be less than 70 mmHg from the viewpoint of brake performance, while the intake air noises are suppressed more effectively with the increase of throttling of the intake air passage, and it has been found by the experiments that the noise energy is reduced by more than ½ in the case where the amount of throttling of the intake air shutter valve is more than 15 mmHg as compared with the case in which no intake air shutter valve is provided in the intake air passage. Thus, it is seen that, during speed retardation in which the exhaust brake is operated, the amount of throttling of the intake air shutter valve should preferably be in the range between 15 and 70 mmHg from the viewpoints of the braking performance and reduction of intake air noises.

When the foregoing results of studies are synthetically taken into consideration, it is understood that after the engine has warmed up, if the amount of throttling of the intake air shutter valve is set to be more than 100 mmHg, and more preferably, in the range of 150 mmHg to 350 mmHg in the light-load period, and also set to be in the range of 15 mmHg to 70 mmHg in the reduced speed period, the exhaust brake functions effectively, with simultaneous elimination of vibrations and noises of the engine.

SUMMARY OF THE INVENTION

Accordingly, an essential object of the present invention is to provide an improved air intake arrangement for use in a Diesel engine which is intended to reduce vibrations and noises of the engine during light-load operation and also to improve the state of combustion of the engine during its cold (warm-up) period through provision of a device for reducing the amount of throttling of an intake air shutter device while the engine is running cold.

Another important object of the present invention is to provide an improved air intake arrangement of the above described type which is equipped with the intake air shutter device provided in an intake air passage so as to throttle the amount of intake air by closing the shutter device during light-load operation, and in which a device for reducing the amount of throttling of the intake air shutter valve even during speed retardation of the engine, is provided so as to reduce intake air noises during the engine speed retardation, and simultaneously to exhibit favorable braking performance upon operation of the exhaust brake.

A further object of the present invention is to provide an improved air intake arrangement of the above described type which is simple in construction and stable in functioning with high reliability, and can be readily incorporated into Diesel engines of various types at low cost.

In accomplishing, these and other objects, according to one preferred embodiment of the present invention, there is provided an air intake arrangement for a Diesel engine having an intake air passage and an exhaust passage, which comprises an intake air shutter device provided in the intake air passage for controlling the passage area of the intake air passage, and having an intake air shutter valve movably provided in the intake air passage for selective opening and closing of the intake air passage. The intake air shutter valve which is adapted to be closed at least in the case of engine idling and to be opened upon increase of load during light-load operation is arranged to reduce the passage area so that negative intake pressure at its downstream side becomes higher than 100 mmHg during the engine idling. The arrangement further includes a detection device for detecting temperature condition of the engine, and a first device for increasing the passage area of the intake air passage while the engine is running cold.

By the arrangement according to the present invention as described above, an improved air intake arrangement has been advantageously presented in which engine vibrations and noises during light-load operation are reduced, and deterioration of combustion is prevented while the engine is running cold, while the braking effect of the exhaust brake is sufficiently maintained during the exhaust braking period, with substantial elimination of disadvantages inherent in the conventional air intake arrangements of this kind.

BRIEF DESCRIPTION OF THE DRAWINGS

These and other objects and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
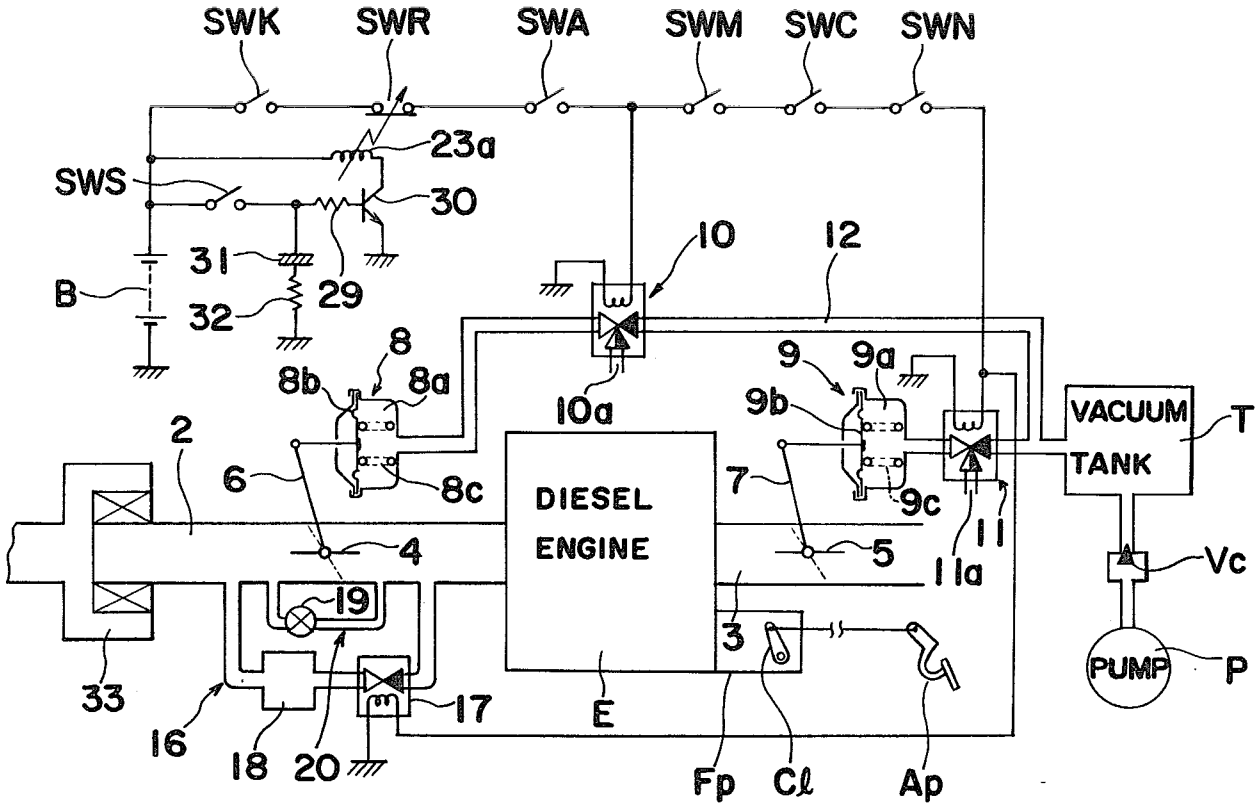
FIG. 1 is a schematic diagram showing an overall construction of an air intake arrangement for a Diesel engine according to one preferred embodiment of the present invention.
Figure 2:
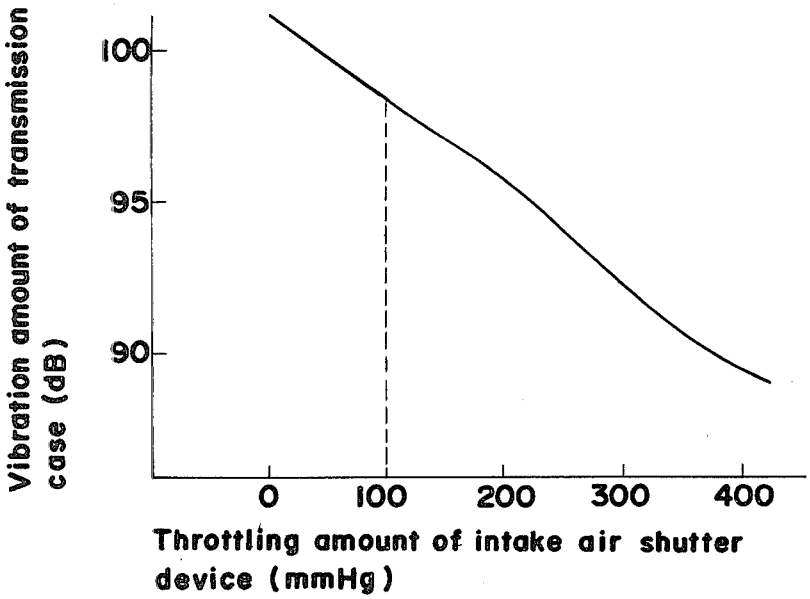
FIG. 2 is a graph showing the relation between the amount of throttling of an intake air shutter device and amount of vibrations of a transmission case upon completion of engine warm-up and during idling operation of the engine.

Referring now to the drawings, there is shown in FIG. 1 a general construction of an air intake arrangement according to one preferred embodiment of the present invention, which generally includes a Diesel engine block E and an intake air passage 2 and an exhaust passage 3 each connected to the engine block E for communication with a combustion chamber (not particularly shown) of the engine block E, while the intake air passage 2 has an intake air shutter valve 4 operably provided therein, with the exhaust passage 3 also having an exhaust brake valve 5 operably installed therein for selective opening and closing of the passages 2 and 3 respectively. The construction of FIG. 1 further includes a fuel injection pump Fp driven by the engine E and provided with a mechanical governor (not shown) for injecting into the combustion chamber, the amount of fuel to be fundamentally determined by the opening degree or angle of a control lever Cl connected to an accelerator pedal Ap through cables and links, etc. and the number of revolutions of the engine E to be detected by a centrifugal governor of the governor device (not shown).

The intake air shutter 4 and exhaust brake valve 5 are respectively coupled to a first power chamber 8 and a second power chamber 9 through link mechanisms 6 and 7, and normally urged to be maintained at open positions by spring members 8*c* and 9*c* provided in the power chambers 8 and 9, and also arranged to be rotated to closed positions through action of diaphragms 8*b* and 9*b* incorporated in the chambers 8 and 9 when negative pressure chambers 8*a* and 9*a* of said chambers 8 and 9 are brought into a state of negative pressure.

The negative pressure chambers 8*a* and 9*a* of the power chambers 8 and 9 are respectively connected to a vacuum tank T through a negative pressure passage 12 equipped with a first three-way solenoid valve 10 and a second three-way solenoid valve 11. A vacuum pump P to be driven by the engine E is further connected to the vacuum tank T through a check valve Vc. The three-way solenoid valves 10 and 11 are arranged to close the negative pressure passage 12 during their de-energized non-functioning periods so that the negative pressure chambers 8*a* and 9*a* of the power chambers 8 and 9 communicate with the atmosphere through air vents 10*a* and 11*a*, and to open the negative pressure passage 12 during their energized functioning periods so that the negative pressure chambers 8*a* and 9*a* communicate with the vacuum tank T.

Figure 3:
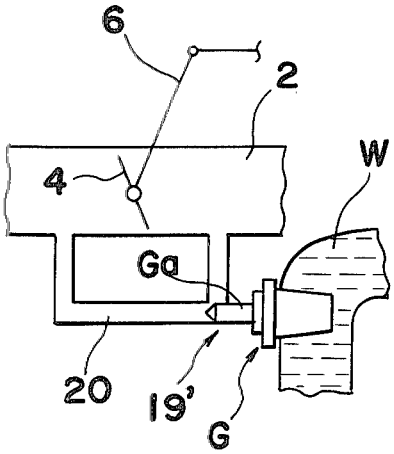
FIG. 3 is a fragmentary schematic diagram showing, on an enlarged scale, the main portion of the air intake arrangement employed in the Diesel engine of FIG. 1.
Figure 4:
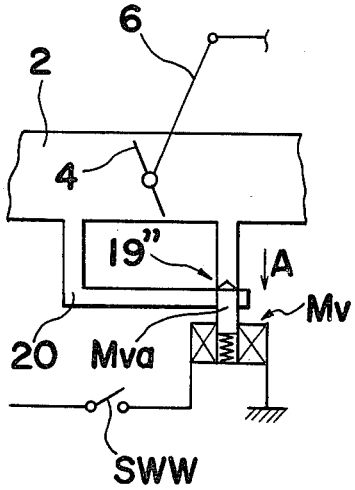
FIG. 4 is a diagram similar to FIG. 3, which particularly shows a modification thereof.

Connected in parallel to the intake air passage 2 are a first by-pass passage 16 which connects the upstream side of the intake air shutter valve 4 with the downstream side thereof and which is equipped therein with a magnet valve 17 arranged to open only during functioning of the exhaust brake and a silencer 18 (expansion chamber) for further reducing intake air noises during actuation of the exhaust brake, and a second by-pass passage 20 which also connects the upstream side of the shutter valve 4 with the downstream side thereof through an on/off valve 19 arranged to be opened during cold running periods of the engine E and constructed as described below with reference to FIGS. 3 and 4.

The arrangement of FIG. 1 further includes a battery or power source B connected at its one side, to the ground and at its other side, to a series-connection of a key switch SWK to be closed upon operation of the engine E, a starting relay switch SWR to be opened for several seconds during cranking at the starting of the engine E and after the cranking, and an accelerator switch or idling switch SWA arranged to be opened upon depression of the accelerator pedal Ap and to be closed upon release thereof.

It is to be noted that the accelerator switch SWA may be provided directly on the accelerator pedal Ap, but it may be so modified that the accelerator switch SWA is provided on the control lever Cl of the fuel injection pump Fp so as to function as a switch for detecting the idling position of the lever Cl in the state where the depression of the accelerator pedal Ap has been released.

Furthermore, with respect to the accelerator switch SWA, there are further connected in series, a manual switch SWM to be selectively opened or closed through manual operation according to the choice of an operator, a clutch switch SWC arranged to be opened upon depression of a clutch pedal (not shown) and to be closed upon releasing thereof, and a neutral switch SWN which is to be closed at the speed change-over position.

One terminal of the first three-way solenoid valve 10 is connected to a circuit portion between the accelerator switch SWA and the manual switch SWM, with the other terminal thereof being grounded. Meanwhile, one terminal of the second three-way solenoid valve 11 is connected to the neutral switch SWN, and the other terminal thereof is grounded.

To the line leading from the battery B to the key switch SWK, there is connected a starter switch SWS which is in turn connected to the base of a transistor 30 through a resistor 29. The collector of the transistor 30 is connected to an exciting coil 23*a* (starting relay switch SWR) which is in parallel with the starter switch SWS, with the emitter thereof being grounded. Between the starter switch SWS and the resistor 29, there are connected in series, a capacitor 31, and a resistor 32 suitably grounded, which are arranged to open the starting relay switch SWR during the cranking time in which the starter is functioning and for several seconds subsequent thereto, and to close the same during starting of the intake air shutter valve 4 so as not to obstruct the starting. An air cleaner 33 is further coupled to the intake air passage 2 as shown.

In the above arrangement, since the accelerator pedal Ap is released from depression during the idling operation, the accelerator switch SWA is kept closed (It is needless to say that the key switch SWK and starting relay switch SWR are also closed). Accordingly, since the first three-way solenoid valve 10 is energized to open, the negative pressure is introduced from the vacuum tank T, through the negative pressure passage 12, into the negative pressure chamber 8*a* of the first power chamber 8, whereby the diaphragm 8*a* is deflected so as to rotate the intake air shutter valve 4 to the closed position (position shown by the dashed line in FIG. 1) through the link mechanism 6. In the above case, the amount of throttling of the intake air shutter valve 4 should be in the range above 100 mmHg and below 400 mmHg, and preferably between 150 and 350 mmHg.

In the idling operation as described above, the air flow in the intake passage 2 may be left as it is when the engine E is in a warmed-up condition, but if the engine E is running in the cold state, the on/off valve 19 is opened for communication through the second by-pass passage 20 so as to reduce the amount of throttling of the intake air shutter valve 4. Needless to say, the on/off valve 19 may be closed when the engine warms up.

Since the amount of throttling of the intake air shutter valve 4 is varied according to the idling operation and warmed-up state or cold state of the engine E, the vibrations and noises of the engine E are advantageously reduced, without deterioration of the state of combustion even under the cold state of the engine E.

On the other hand, when the exhaust brake is operated, the clutch pedal is not depressed, with the change-lever being located at any of the change-over positions, and therefore, both the clutch switch SWC and neutral switch SWN are closed.

Therefore, since the second three-way solenoid valve 11 is energized to open upon closing of the manual switch SWM by the operator, the negative pressure is introduced from the vacuum tank T into the negative pressure chamber 9*a* of the second power chamber 9, and the exhaust brake valve 5 is brought to the closed position by the action of the diaphragm 9*b* through the link mechanism 7, and thus, the exhaust brake is operated.

Meanwhile, simultaneously with the energization of the second three-way solenoid valve 11, the magnet valve 17 is energized to open, and thus, the second by-pass passage 16 is opened. When the second by-pass passage 16 is opened in the above described manner, the amount of throttling of the intake air shutter valve 4 which is more than 100 mmHg is reduced to 15 to 70 mmHg.

It is to be noted here that, as described earlier, the amount of throttling of the intake air shutter valve 4 is represented by the value as converted into the intake air negative pressure during the idling operation, i.e. the pressure during the idling when the intake air shutter valve 4 is closed, with the by-pass passage 16 opened, and the intake negative pressure downstream of the intake air shutter valve 4 during the actual speed retardation, will show values larger than the above due to the larger number of revolutions.

Accordingly, during operation of the exhaust brake, since the amount of throttling of the intake air shutter valve 4 becomes a set amount in the range 15 to 70 mmHg which is below that during the idling operation (100 mmHg), there is no counter-flow pressure wave to the intake air passage 2, and thus there is a consequent reduction of intake air noises. Moreover, in the above state, since the intake air amount is larger than a predetermined amount, there is no reduction of the brake performance, either.

Furthermore, when the operation of the exhaust brake is not required, i.e. either when the accelerator switch SWA is open or when any of the manual switch SWM, clutch switch SWC and neutral switch SWN is open, the second three-way solenoid valve 11 is not energized, and the magnet valve 17 is not opened.

Meanwhile, since the clutch switch SWC and neutral switch SWN arranged are so that at least one of them will be opened during the idling operation so as to make the exhaust brake ineffective, the arrangement may be modified so that these switches SWC and SWN are replaced by a revolution switch (not shown) which is arranged to be opened during the idling operation and to be closed at an engine rpm slightly larger than that during the idling operation.

It is to be noted here that the accelerator switch SWA, clutch switch SWC and neutral switch SWN described above need not necessarily be of the type directly responding to the movements of the accelerator pedal, clutch pedal and gear change lever, but may be modified to such a type as will indirectly detect the movements thereof, and that the manual switch SWM described as employed in the foregoing embodiment may be omitted depending on the requirement.

Referring also to FIGS. 3 and 4 respectively showing one example and a modification of the on/off valve 19 described as employed in the arrangement of FIG. 1 for closing the second by-pass passage 20 after the engine has warmed up and opening passage 20 during cold running period of the engine, the on/off valve 19′ of FIG. 3 is constituted by a wax pellet G which is arranged to be controlled by the temperature of engine cooling water W so as to totally close the by-pass passage 20 upon completion of engine warm-up (for example, when the temperature of the engine cooling water W exceeds 80° C.) and to open passage 20 during the cold period of the engine E by its valve member Ga. Moreover, owing to the characteristics of the wax pellet G, the lower the temperature of the engine cooling water W, the smaller is the amount of projection of the valve member Ga of the wax pellet G into the by-pass passage 20, and consequently, the amount of throttling of the intake air shutter valve 4 is continuously varied. More specifically, when the temperatures of the engine cooling water W are below the set temperature of 80° C., the amount of throttling of the intake air shutter valve 4 varies according to the temperature, and the amount of throttling is decreased with the falling of the temperature of the engine cooling water W.

Therefore, by the arrangement of FIG. 3, since the amount of throttling of the intake air shutter valve 4 is continuously varied corresponding to the temperature of the engine cooling water W, i.e. according to each state of the cold engine condition, extremely favorable engine operation can be achieved.

In the modification of FIG. 4, the on/off valve 19″ is constituted by a magnet valve Mv which is incorporated in the by-pass passage 20 connecting the upstream side and downstream side of the intake air shutter valve 4, and which has, in its exciting circuit, an engine warm-up switch SWW arranged to be closed during the cold running period of the engine E for energizing the magnet valve Mv. Accordingly, during the cold running period of the engine, the magnet valve Mv is energized by closing the switch SWW, with its valve member Mva moving along the peripheral wall of the by-pass passage 20 in the direction indicated by the arrow A for communication of the passage 20. As described above, during the idling operation, if the engine E is cold, the amount of throttling of the intake air shutter device may be reduced.

It should be noted here that the negative pressure described as utilized in the foregoing embodiment may be replaced by compressed air, in which case, it may be so arranged that, with the vacuum pump P replaced by a compressor, the intake air shutter valve 4 and exhaust brake valve 5 are closed when a positive pressure is applied to the power chambers 8 and 9.

Figure 5:
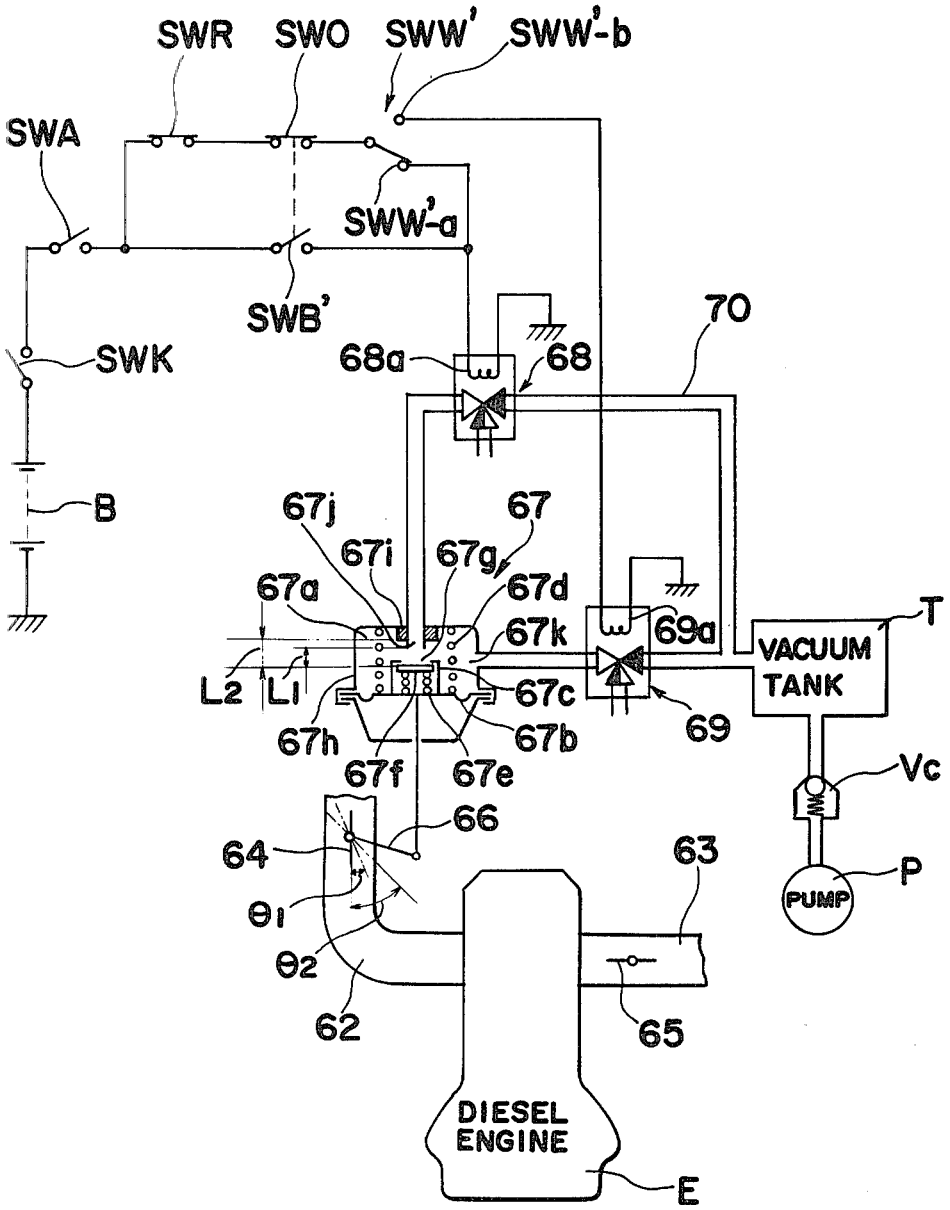
FIG. 5 is a schematic diagram similar to FIG. 1, which particularly shows an arrangement according to another embodiment of the present invention.

Reference is made to FIG. 5 showing the air intake arrangement according to a second embodiment of the present invention. The arrangement of FIG. 5 utilizes a power chamber 67 of two stage or double functioning type, and includes an intake air shutter valve 64 operably provided in the intake air passage 62 and an exhaust brake valve 65 also operably provided in the exhaust passage 63 of the Engine E for selective opening or closing of the passages 62 and 63.

The intake air shutter valve 64 is coupled to a power chamber 67 of double-functioning type through a link mechanism 66. The power chamber 67 includes a negative pressure chamber 67*a* defined by an outer casing 67*h* and an inner casing 67*c* of U-shaped cross section fixed, at its base portion, to the central portion at the negative pressure side of a diaphragm 67*b* within the chamber 67*a*. Inside the negative pressure chamber 67*a* and the inner casing 67*c*, there are respectively accommodated a coil spring 67*d* of large diameter and another coil spring 67*e* of small diameter so as to urge the diaphragm 67*b* for downward deflection by the coil spring 67*d*, while, within the inner casing 67*c*, a valve plate 67*f* is supported by the upper portion of the coil spring 67*e* for being urged upward by the coil spring 67*e* so as to normally close an opening 67*g* formed at the central portion in the upper surface of the inner casing 67*c*. At the central portion of the upper wall of the outer casing 67*h*, i.e. at the portion thereof confronting the upper surface of the inner casing 67*c*, there is fixed a stopper 67*i* which comes into contact with the upper surface of the inner casing 67*c* upon upward deflection of the diaphragm 67*b* so as to prevent the inner casing 67*c* from a further displacement, while a pipe member 67*j* extends, at its one end, through the upper wall of the outer casing 67*h* and the central portion of the stopper 67*i* into the negative pressure chamber 67*a* so as to be projected by a predetermined amount from the lower surface of the stopper 67*i*, with a side wall port 67*k* being opened in the negative pressure chamber 67*a* of the outer casing 67*h*.

Accordingly, it is so arranged that, when the diaphragm 67*b* is deflected by a first set amount $L_1$, the corresponding end of the pipe member 67*j* is brought into contact with the valve plate 67*f* and when the diaphragm 67*b* is deflected by a second set amount L2 which is larger than the first set amount $L_1$, the inner casing 67*c* contacts the stopper 67*i*.

The pipe member 67*j* and side wall port 67*k* of the power chamber 67 are coupled to the vacuum tank T through negative pressure passages 70 respectively provided with a first three-way solenoid valve 68 and a second three-way solenoid valve 69, while the vacuum tank T is further connected to the vacuum pump P through the check valve Vc.

The key switch SWK and accelerator switch SWA are connected in series with the battery or power source B, while a parallel connection of the exhaust brake switch SWB', starting relay switch SWR, on/off switch SWO and engine warming-up switch SWW' is connected to the accelerator switch SWA. The switches as described above may be of generally similar constructions to those in the first embodiment except for the exhaust brake switch SWB', engine warm-up switch SWW' and on/off switch SWO.

The exhaust brake switch SWB' arranged to be closed during speed retardation at least when the exhaust brake valve 65 is closed, is substantially constituted by the manual switch SWM, clutch switch SWC and neutral switch SWN described in the first embodiment of FIG. 1.

The exhaust brake switch SWB' and cold side terminal SWW'-a of the engine warm-up switch SWW' is connected to one side of an exciting coil 68*a* of the first three-way solenoid valve 68, while the hot side terminal SWW'-b of the engine warm-up switch SWW' is coupled to one side of an exciting coil 69*a* of a second three-way solenoid valve 69, with the other sides of the exciting coils 68*a* and 69*a* being grounded. Meanwhile, the on/off switch SWO is associated with the exhaust brake switch SWB', and is arranged to be opened when the switch SWB' is closed and to be closed when the switch SWB' is opened.

The engine warm-up switch SWW' arranged to be switched over according to the state of warm-up of the engine E is set to be changed over from the cold side terminal SWW'-a to hot side terminal SWW'-b when the temperature of the cooling water for the engine E exceeds 80° C.

Although not shown, the exhaust brake valve 65 is arranged to be selectively opened or closed by similar means as in the first embodiment of FIG. 1 (i.e. by the power chamber 9, three-way valve 11, etc.).

In the above arrangement of FIG. 5, the opening degree of the intake air shutter valve 64 is set in such a manner that, when the diaphragm 67*b* is deflected by the first set amount $L_1$, i.e. during functioning of the exhaust brake and idling operation at the cold period of the engine E, the throttling amount of the intake air shutter valve 64 is brought, through the link mechanism 66, into such a range as to develop intake air pressure of 15 ~ 70 mmHg at the idling revolutions of the engine E, and when the diaphragm 67*b* is deflected by the second set amount $L_2$, i.e. for idling operation after the engine has warmed up, the throttling amount is adapted to exceed 100 mmHg through the link mechanism 66.

According to the arrangement described in the foregoing, the engine warm-up switch SWW' is set at the cold side terminal SWW'-a during the cold period of the engine E, and thus, the first three-way solenoid valve 68 is energized during the idling operation (in which case, the key switch SWK, accelerator switch SWA, starting relay switch SWR and on/off switch SWO are closed). Therefore, the first three-way solenoid valve 68 is opened so as to allow the negative pressure to be introduced into the negative chamber 67*a* of the power chamber 67 through the negative pressure passages 70. Meanwhile, the second three-way solenoid valve 69 is not energized to be opened, since the engine warm-up switch SWW' is connected to the cold side terminal SWW'-a. In other words, the negative pressure is introduced only through the pipe member 67*j*.

Accordingly, since the diaphragm 67*b* is deflected by the first set amount $L_1$, the intake air shutter valve 64 is brought into the state where it is rotated by an angle $\theta_1$ with respect to the fully opened state thereof through the link mechanism 66. In the above state, the amount of throttling of the intake air shutter device is brought into the range of 15 to 70 mmHg, and a favorable state of combustion is achieved.

When the engine E is thus brought into the warmed-up state, the engine warm-up switch SWW' is changed over to its hot side terminal SWW'-b. Consequently, the first three-way valve 68 is de-energized to be closed, while the second three-way solenoid valve 69 is energized to be opened. Therefore, different from the case earlier described, the negative pressure is introduced only through the side wall port 67*k*, and therefore, the diaphragm 67*b* is deflected by the second set amount $L_2$ so as to further rotate the intake air shutter valve 62 into a state where it is rotated by an angle $\theta_2$ ($\theta_2 > \theta_1$). In the above state, the amount of throttling of the intake air shutter device is in the range between more than 100 mmHg and less than 400 mmHg.

Meanwhile, during functioning of the exhaust brake, since the exhaust brake switch SWB' is closed, the on/-off switch SWO is to be opened, and thus, the negative pressure is introduced into the negative pressure chamber 67*a* of the power chamber 67 only through the pipe member 67*j* in the similar manner as in the cold period of the engine E. Therefore, the intake air shutter valve 64 is brought into the state where it is rotated by the angle $\theta_1$, with the amount of throttling being in the range of 15~70 mmHg.

It should be noted here that, in the foregoing embodiment, although the engine warming-up switch SWW' is adapted to detect the state of engine warming-up by sensing the cooling water temperature, switch SWW' may be arranged to detect other signals capable of informing the state of engine warming-up, for example, engine oil temperatures, engine atmosphere, etc.

Figure 6:
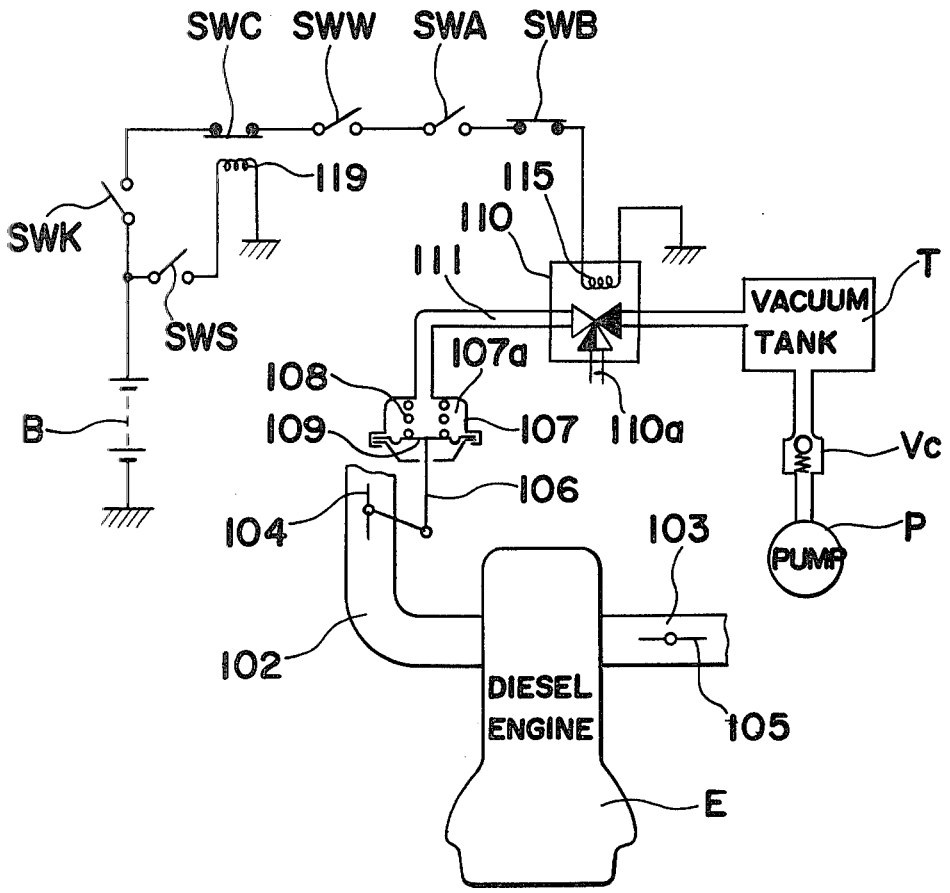
FIG. 6 is a schematic diagram similar to FIG. 1, which particularly shows an arrangement according to a further embodiment of the present invention.

Referring to FIG. 6, there is shown a third embodiment of the air intake arrangement according to the present invention, in which it is so arranged that, with the detection device provided for detecting the warmed-up state of the engine, the closing function of the intake air shutter valve is suspended during the cold period of the engine through detection signal from said detection device for maintaining the predetermined amount of intake air during such cold period of the engine so as to avoid the undesirable semi-misfire. More specifically, the intake air shutter valve is prevented from being closed during the cold period of the engine and during functioning of the exhaust brake even in the light-load operation of reduction of the amount of throttling of the intake air shutter valve i.e. for enlarging the intake air passage.

In FIG. 6, the intake air shutter valve 104 and the exhaust brake valve 105 are operably provided respectively in the intake air passage 102 and the exhaust passage 103 of the Diesel engine E in the similar manner as in the foregoing embodiments for selective closing and opening of the passage 102 and 103. The intake air shutter valve 104 is coupled to the power chamber 107 through the link mechanism 106 so as to be normally held at the opened position by the spring 108 of the power chamber 107, while, when the negative pressure chamber 107*a* of the power chamber 107 is subjected to the negative pressure, the shutter valve 104 is rotated to the closed position by the action of the diaphragm 109 so that, during idling of the engine E, the negative pressure in the intake air passage 102 at the downstream of the intake air shutter valve 104 is in the region of 150~350 mmHg. Similarly, the exhaust brake valve 105 is also arranged to be rotated to the closed position through the power chamber (not shown) during functioning of the exhaust brake. The power chamber 107 is coupled, through a negative pressure passage 111 having a three-way magnet valve 110, to the vacuum tank or pressure tank T to which the vacuum pump or air pump P driven by the engine E is connected through the check valve Vc.

The three-way magnet valve 110 has a solenoid 115 incorporated therein, and is arranged to close the negative pressure passage 111 during its non-functioning period at which the solenoid 115 is de-energized for communicating the negative pressure chamber 107*a* of the power chamber 107 with the atmosphere through the air vent 110*a*, and also to open passage 111 for putting the chamber 107*a* in communication with the vacuum tank T upon energization of the solenoid 115.

To the power source B grounded at its one terminal, there are connected, in series, the key switch SWK to be turned ON for engine operation, normally closed contacts SWC to be turned OFF by a coil 119 energized only during turning ON of the starter switch SWS, warming-up detection switch SWW for detecting the state of engine warm-up, accelerator switch SWA to be turned ON upon depression and turned OFF upon release of the accelerator pedal Ap, normally closed braking detection switch SWB to be turned OFF by detecting the operation of the exhaust brake valve 105, and solenoid 115 of the three-way magnet valve 110 described earlier, with the other terminal of the solenoid 115 being grounded. The normally closed contact SWC is intended to prevent the intake air shutter 104 from being closed while the starter is rotating, the warm-up detection switch SWW is adapted to be turned ON through detection, for example, that the temperature of engine cooling water is higher than 80° C.

The braking detection switch SWB has for its object to prevent the exhaust brake from becoming ineffective when the amount of throttling by the intake air shutter 104 is large during functioning of the exhaust brake. Accordingly, said switch SWB is not limited to be one which is turned OFF through detection of the exhaust brake valve 105, but may be replaced by a switch to be turned OFF through detection of the state of speed reduction, for example, a switch to be turned OFF, for example, at an rpm above a preset amount, which may be slightly higher than that in the idling operation.

In the above arrangement of the intake air shutter device, upon idling commencement of of the engine, with the key switch SWK turned ON during engine warmed-up period, since the normally closed contact SWC, warming-up detection switch SWW, accelerator switch SWA and braking detection switch SWB are in the ON state, the solenoid 115 of the three-way magnet valve 110 is energized to open the negative pressure passage 111 causing the negative pressure chamber 107*a* to communicate with the vacuum tank T. Accordingly, the negative pressure chamber 107*a* of the power chamber 107 is subjected to negative pressure through the vacuum tank T, and thus, the intake air shutter valve 104 is closed via the link mechanism 106. The degree of throttling by the intake air shutter valve 104 after the engine has warmed-up should desirably be in the range higher than 100 mmHg in which the vibrations and noises are comparatively small. On the contrary, if the degree of throttling by the intake air shutter 104 is too large, the combustion becomes unstable even when the engine is warmed-up, giving rise to the semi-misfire, and therefore, the degree of throttling should be less than 400 mmHg, and more preferably, should be in the range of 150~350 mmHg as described earlier from the compatibility of reduction of noises and stable combustion.

Subsequently, during the cold period of the engine, since the warming-up detection switch SWW is in the OFF state even in the idling operation in which the accelerator switch SWA is turned ON, the solenoid 115 of the three-way magnet valve 110 is de-energized to close the negative pressure passage 111, with the negative pressure chamber 107*a* of the power chamber 107 communicating with the atmosphere through the air vent 110*a*, and the diaphragm 109 of the power chamber 107 retains the intake air shutter valve 104 in the opened state through the spring force of the spring 108 via the link mechanism 106.

As described in the foregoing, the degree of throttling of intake air by the shutter valve 104 is made smaller during the cold period of the engine than in the warmed-up period thereof i.e., the amount of intake air is increased so as to achieve temperature rise during compression in the combustion chamber for preventing the occurrence of the undesirable semi-misfire.

Figure 7:
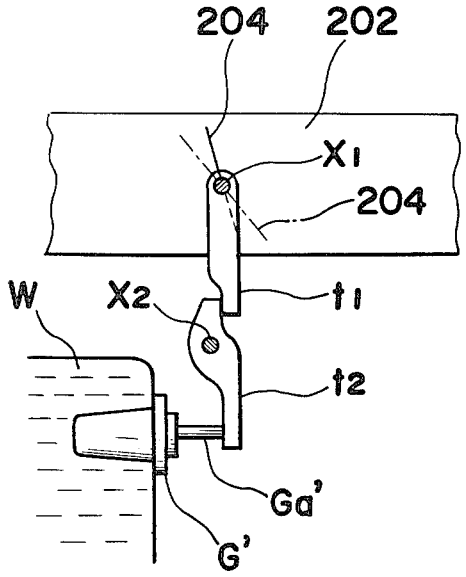
FIG. 7 is a diagram similar to FIG. 3, which particularly shows another modification thereof, FIG. 8(*a*) is a diagram similar to FIG. 3, which particularly shows still another modification thereof, FIG. 8(*b*) is a graph showing the relation between the amount of depression of an accelerator pedal and the degree of opening of the intake air shutter valve.

Referring to FIG. 7, there is shown another modification of the arrangement of FIG. 3, in which it is intended to reduce the amount of throttling of the intake air shutter device during the cold period of the engine by restricting the amount of closing of the intake air shutter valve itself during the cold period of the engine.

In the modification of FIG. 7, within the intake air passage 202, there is operably provided the intake air shutter valve 204 which is brought into the closed position at least during idling operation of the engine E for selective closing and opening of the passage 202, with a first lever member $t_1$ being fixed at its one end, to the pivotal shaft $X_1$ of intake air shutter valve 204. There is also provided a second lever member $t_2$ which is pivotally supported by a pivotal shaft $X_2$ at a central portion thereof, and coupled at its one end, to the other end of the first lever member $t_1$, and at its other end, to a shaft member Ga' of the wax pellet G' in which the amount of projection of the shaft member Ga' is controlled by the temperature of the engine cooling water W.

Accordingly, since the temperature of the engine cooling water W is low, for example, below about 80° C. and consequently, the amount of projection of the shaft member Ga' of the wax pellet G' is small during the cold period of the engine E, if it is intended during idle operation, to increase the amount of throttling of the intake air shutter valve 204 by rotating said shutter valve 204 from its fully opened state, the second lever member $t_2$ functions as a stopper to contact the first lever member $t_1$, and thus, the intake air shutter valve 204 is prevented from being rotated through an angle larger than the predetermined angle as shown by the dotted line in FIG. 7. Therefore, when the engine has warmed up, since the temperature of the engine cooling water W has risen, the amount of projection of the shaft member Ga' increases, with an increase of the throttling amount of the intake air shutter valve 204 up to more than 100 mmHg as shown in the solid line in FIG. 7.

Incidentally, in the embodiments described with reference to FIGS. 1 through 6, it is so arranged that the intake air shutter valve is closed only during the idling operation (i.e. when the accelerator pedal Ap is released from the depression), with the intake air shutter valve being fully opened in the cases other than the above. However, in actual practice, since the torque variation takes place due to presence of excessive air even during low speed and light-load operation slightly higher in the number of revolutions than that in the idling operation (600 r.p.m.), it is desirable to increase the amount of throttling of the intake air shutter device. However, even in the slow speed operation, since the amount of necessary air increases to be large during heavy-load operation in which the amount of fuel injection is large, it is not preferable to increase the amount of throttling of the intake air shutter device.

Accordingly, it is seen that the intake air shutter device may be throttled during low speed revolutions and light-load operation, and fully opened during high speed revolutions and heavy-load operation.

Figure 8:
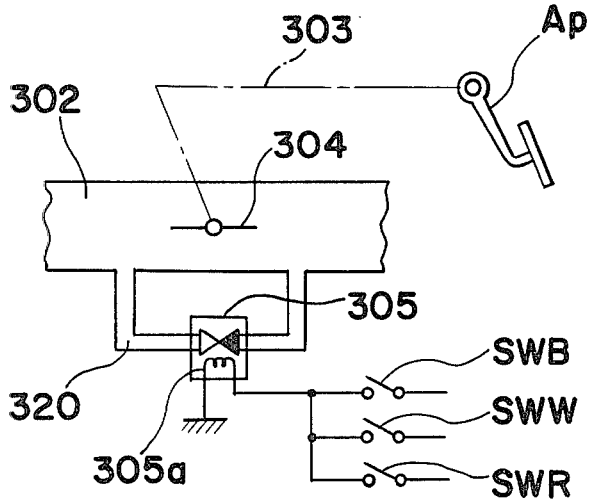
Figure 8:
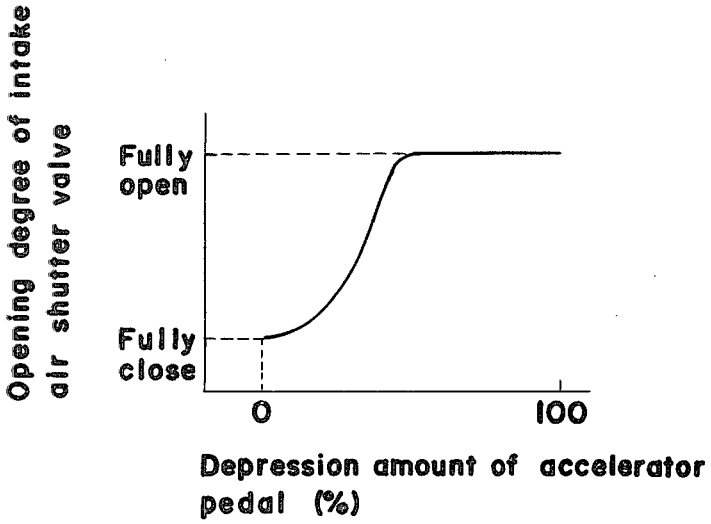

Referring to FIG. 8(*a*), still another modification of the intake air shutter device will be described hereinbelow in which the degree of opening of the intake air shutter valve is arranged to be continuously varied for eliminating the above problem through direct association of the intake air shutter valve with the accelerator pedal.

In the modification of FIG. 8(*a*), the intake air shutter valve 304 is connected to the accelerator pedal Ap through the link mechanism 303. As is seen from the graph of FIG. 8(*b*), the intake air shutter valve 304 is so arranged as to be fully closed (the amount of throttling is between more than 100 mmHg and less than 400 mmHg) during idling operation, and to be gradually opened with the increase of the degree of depression of the accelerator pedal and consequent increase of the engine revolutions in the case of a fuel injection pump utilizing an all speed governor, or with the increase of the load in the case of a limit speed governor, and thus, to be fully opened upon arrival at the predetermined value. An the by-pass passage 320 connecting the upstream side and downstream side of the intake air shutter valve 304, there is provided the magnet valve 305 whose exciting coil 305*a* is electrically connected to the operating switches such as the exhaust brake switch SWB to be closed upon closing of the exhaust brake valve, engine warming-up switch SWW to be closed during cold operation of the engine and switch SWR, etc. Therefore, upon closure of one of the switches SWB, SWW and SWR, the by-pass passage 320 is opened, with consequent reduction of the amount of throttling of the intake air shutter device to 15~75 mmHg.

Figure 9:
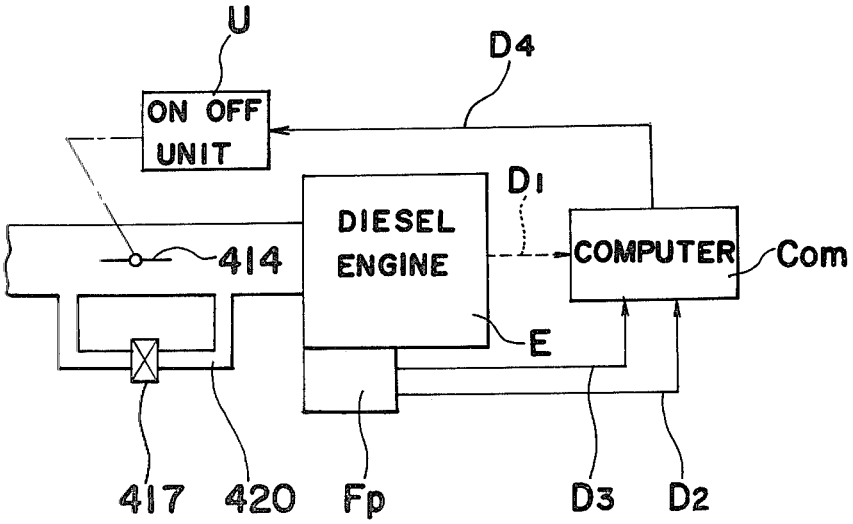
FIG. 9 is a schematic diagram similar to FIG. 1, which particularly shows an arrangement according to a further embodiment.

Referring further to FIG. 9, there is shown an arrangement in which a computer is employed for the control of the degree of opening of the intake air shutter valve. In the arrangement of FIG. 9, the engine E and fuel injection pump Fp to be driven by the engine E are coupled to a computer Com which transmits signal $D_4$ to an on/off unit U for the motors, etc. which adjust the degree of opening of the intake air shutter 414 associated with on/off unit U, according to signals $D_1$ for engine temperature and the like from the engine E, fuel injection amount signal $D_2$ (load signal) from the fuel injection pump Fp and engine speed signal $D_3$, etc. In the by-pass passage 420 connecting the upstream side and downstream side of the intake air shutter valve 414, there is provided the magnet valve 417 which is opened upon receipt of the signal indicating the functioning of the exhaust brake for reducing of the amount of throttling of the intake air device.

In the arrangement of FIG. 9 also, the opening of degree of the intake air shutter valve 414 is controlled according to the degree of depression of the accelerator pedal, engine revolutions, and fuel injection amount, etc. in a similar manner as in the previous embodiment, with the characteristics as in the last embodiment.

It should be noted here that, although all of the foregoing embodiments are mainly described with reference to the air intake arrangement as applied to motor vehicles, the present invention is not limited in its application to the motor vehicles alone, but is readily applicable to air intake arrangements of Diesel engines for various industrial machines in general.

As is clear from the foregoing description, according to the present invention, since it is so arranged that the amount of throttling of the intake air shutter device is decreased during cold operation of the engine in the air intake arrangement of the Diesel engine provided with the intake air shutter device for throttling the amount of intake air during light-load operation, the invention has the superior effect in practical application that the vibrations and noises of the engine may be reduced without deterioration of the state of combustion.

Although the present invention has been fully described by way of example with reference to the accompanying drawings, it is to be noted that various changes and modifications will be apparent to those skilled in the art. Therefore, unless such changes and modifications otherwise depart from the scope of the present invention, they should construed as included therein.

What is claimed is:

1. In a system including a diesel engine and a starter motor for starting the diesel engine, the diesel engine having an air intake passage for introducing air into a combustion chamber of the diesel engine, an exhaust passage, and an injection nozzle means, directed into the combustion chamber, for supplying fuel into the combustion chamber so as to effect combustion by injecting the fuel into the air which is compressed in the combustion chamber so as to be raised in its temperature, an improved air intake arrangement which comprises:

means, including an air intake shutter valve, provided in the air intake passages, for controlling the size of the air passage area of the air intake passage;

means for establishing an intake negative pressure at the downstream side of said shutter valve of between 100 and 400 mmHg by closing said shutter valve during idling of the diesel engine, and for fully opening said shutter valve during medium to high engine loads; and said controlling means including a correction means, responsive to both the temperature of the diesel engine and operation of the starter motor, for increasing the size of the air passage area of the air intake passage while the diesel engine is warming up and during operation of the starter motor, to a size which is larger than the size of the air passage area of the air intake passage while the diesel engine is idling after the diesel engine has warmed up.

2. An air intake arrangement as in claim 1, wherein said correction means includes means for increasing the degree of opening of said shutter valve.

3. An air intake arrangement as in claim 1, wherein said correction means includes a structure having a passage for by-passing said shutter valve and a valve device for selectively opening and closing said passage for by-passing said shutter valve while the diesel engine is warming up and during operation of the starter motor.

4. An air intake arrangement as in claim 1, further including an exhaust brake valve in said exhaust passage and means for closing said exhaust brake valve and concurrently affecting said correction means to increase the size of the air passage area of the air intake passage during retardation of the diesel engine.

5. An air intake arrangement as in claim 4, wherein the size of the air passage area of the air intake passage during the retardation of the diesel engine is larger than the size of the air passage area of the air intake passage while the diesel engine is warmed up and is idling, and is smaller than the size of the air passage area of the air intake passage while said shutter valve is fully opened.

6. An air intake arrangement as in claim 5, wherein said correction means comprises means for establishing an air intake negative pressure of 15 to 70 mmHg downstream of said shutter valve.

7. An air intake arrangement as in claim 1, wherein said controlling means includes means, responsive to a first signal, for moving said air shutter valve to vary the size of the air passage area of the air intake passage;

means for generating a second signal indicative of the quantity of fuel being directed into the combustion chamber by the injection nozzle means;

means for generating a third signal indicative of the speed of the diesel engine;

means for generating a fourth signal indicative of the temperature of the diesel engine; and computer means, responsive to said second, third and fourth signals, for generating and transmitting to said moving means said first signal.

* * * * *